United States Patent [19]

Howell

[11] Patent Number: 4,651,975

[45] Date of Patent: Mar. 24, 1987

[54] INSERT MEMBER FOR CHAIN LINK FENCES

[76] Inventor: Venice T. Howell, 1425 Cabrillo Ave., Burlingame, Calif. 94010

[21] Appl. No.: 822,547

[22] Filed: Jan. 27, 1986

[51] Int. Cl.[4] ..... B21F 27/00; E04H 17/02

[52] U.S. Cl. ..... 256/32; 256/1; 404/35; 405/17

[58] Field of Search ..... 256/32, 12.5, 34, 35, 256/1; 404/35, 46; 405/17, 18, 19, 20

[56] References Cited

U.S. PATENT DOCUMENTS

| | | | |
|---|---|---|---|
| 649,323 | 5/1900 | Litz | 404/46 X |
| 991,041 | 5/1911 | Toennes | 405/20 |
| 2,954,964 | 10/1960 | O'Haffey | 256/34 |
| 3,069,142 | 12/1962 | Kessler | 256/34 |
| 3,774,884 | 11/1973 | Singer | 256/32 |
| 4,286,895 | 9/1981 | Poli | 405/17 |

FOREIGN PATENT DOCUMENTS

| | | | |
|---|---|---|---|
| 527116 | 3/1954 | Belgium | 405/20 |

*Primary Examiner*—Andrew V. Kundrat

*Attorney, Agent, or Firm*—Thomas M. Freiburger

[57] ABSTRACT

A device designed to be secured to a chain link fence improves the appearance of the fence and partially closes the openings in the fence so as to provide privacy and wind protection. Decorative blocks, such as of wood or plastic, are installed onto the obliquely angled wires of the fence via a wire-receiving groove formed in one surface of each block. Each block extends partially over each of two adjacent fence openings on either side of the wire. Flexible connectors, such as of light wire, are strung generally in lines to connect the series of blocks and secure their position and orientation. Installation of a large number of the blocks provides the appearance of a closed fence, improves the appearance of the fence and provides some wind protection.

15 Claims, 3 Drawing Figures

INSERT MEMBER FOR CHAIN LINK FENCES

BACKGROUND OF THE INVENTION

The invention relates to fence apparatus, and more specifically to a device attachable to chain link fences to improve appearance and afford privacy.

Several types of apparatus have been used previously in order to partially close the openings formed among the woven wires of a chain link fence. For example, see U.S. Pat. Nos. 2,954,964, 3,069,142 and 3,774,884, issued to O'Haffey, Kessler and Singer. The Kessler patent is directed to what have been known in the industry as "filler strips". The metal strips are of a width which enables them to be pushed into a line of recesses formed in the chain link fence, and of length sufficient to extend obliquely from the bottom to the top of the fence, covering most of each opening along that oblique line. Oppositely angled filler strips are woven into the fence to lock the first group of strips in place.

The filler strips, while being effective to close most of the open space in a chain link fence, have been unattractive, have been time consuming to install, and have tended to rattle in the wind.

It is an object of the present invention to provide a privacy device and system for chain link fences which is considerably more attractive than anything available in the prior art and which is also easily and quickly installed.

SUMMARY OF THE INVENTION

In accordance with the present invention, a decorative chain link fence insert member, which may be of wood or other material, is easily installed over the wires of the fence, such that a matrix comprising a large number of similar insert members can be used to cover most of the space defined among the woven wires of the fence.

Each insert member may comprise a square or rectangular block with a linear slot in its rear side, to receive a wire of the fence between two adjacent fence openings. Rows of the blocks are installed on the fence and are arranged generally linearly in oblique lines. Flexible members such as wires may be used to connect each line of blocks so as to hold them in position and proper orientation on the fence. The flexible members may be threaded through bores in the blocks, transverse to the wire-receiving slots and crossing through the slots, so that the blocks are closely held in position on the wires and prevented from substantial movement.

In this way, the openings in a chain link fence are partially closed in an efficient and economical manner, with a quickly installed system which improves the appearance of the fence. The system also affords privacy and partial wind protection.

It is therefore among the objects of the invention to provide a chain link fence insert system for privacy and wind protection, which is easily and efficiently installed and which actually improves, rather than detracts from, the appearance of the fence. These and other objects, advantages and features of the invention will be apparent from the following description of a preferred embodiment, considered along with the accompanying a preferred embodiment, considered along with the accompanying drawings.

DESCRIPTION OF THE DRAWINGS

FIGS. 2 and 3 show the manner of attachment of the blocks to the wires of the fence, and a preferred arrangement for interconnecting blocks and securing them in position on the fence.

DESCRIPTION OF A PREFERRED EMBODIMENT

Figure 1:
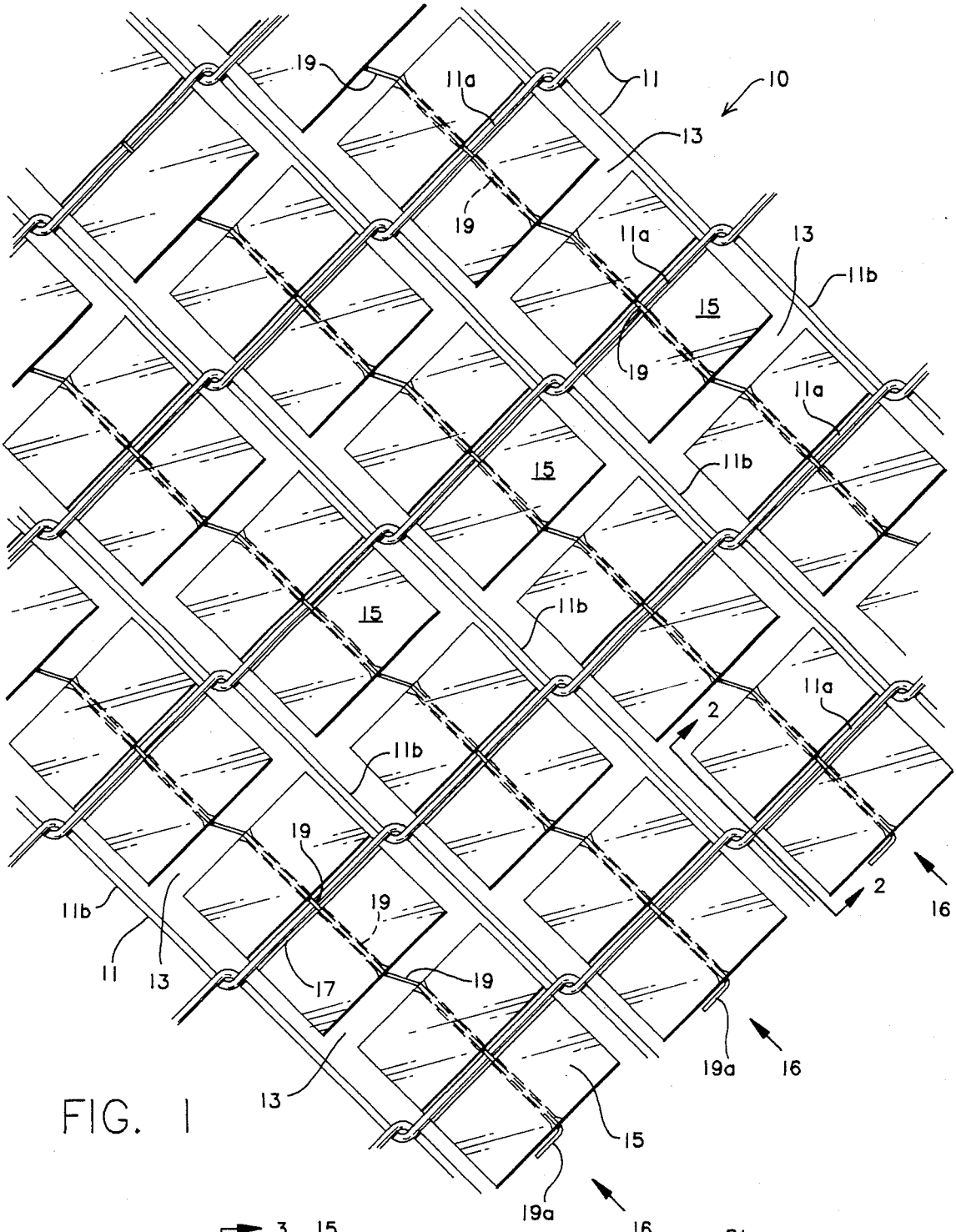
FIG. 1 is an elevation view showing series of fence insert members or blocks according to the invention installed on a chain link fence.

In the drawings, FIG. 1 shows a chain link fence 10 of conventional configuration, comprising a series of obliquely angled woven wires 11.

The wires are pre-formed in zig-zag configuration and twisted together in the well known manner to form the fence fabric. For purposes of this discussion, wire portions oriented in the oblique direction ascending to the right in FIG. 1 are denoted 11*a*, while wire portions oriented in the opposite oblique direction are denoted 11*b*. Diamond-shaped openings 13 are formed among the wires.

Within the fence 10 is shown, covering and partially closing a portion of the area thereof, a system of fence insert members or blocks 15 arranged generally linearly in rows 16. Each insert member 15 covers a portion of each of two adjacent diamond-shaped openings 13. Any given opening is therefore substantially covered or mostly covered, by portions of two adjacent insert members 15.

Figure 2:
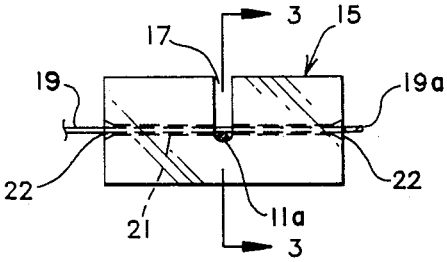
FIG. 2 is a sectional view showing one of the insert blocks, as seen along the line 2—2 in FIG. 1.
Figure 3:
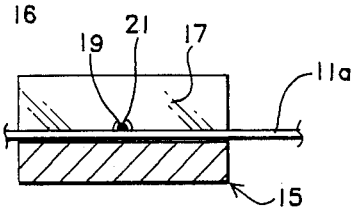
FIG. 3 is a sectional view seen along the line 3—3 in FIG. 2. Both

FIG. 2 shows generally the manner of installation of the insert members or blocks 15. Each has a slot 17 formed in one surface (which may be called the back surface, also shown in FIG. 1) as shown, and this slot receives a wire 11*a* of the fence. To provide an adequately seated connection onto the fence, each groove or slot 17 may be in the range of about $\frac{3}{8}$ to $\frac{5}{8}$ inch in depth, preferably about $\frac{1}{2}$ inch, in a block 15 having a thickness for example, of about $\frac{3}{4}$ inch to $\frac{7}{8}$ inch.

Once an entire row 16 of the blocks 15 has been pressed into place, all of the blocks of the row are tied together and locked onto the fence, so as to keep them in position and in alignment and to prevent them from falling forward off the fence. A preferred means for so connecting the blocks comprises a flexible member such as a wire or string 19 extending generally in a line and connecting all blocks 15 in a row. These flexible members 19 preferably are connected to the blocks via preformed bores 21 through which the string or wire 19 is threaded, as illustrated in the drawings.

The flexible string or wire in this preferred embodiment extends through the insert members 15 generally perpendicular to the slot 17. The bores 21 are located to cross the slots 17 near the bottom of each slot, but leaving depth enough to receive the wire 11*a* between the wire 19 and the bottom of the slot. Each bore 21 may have a conical entrance and exit 22 to ensure easy threading of the wire 19 through the blocks.

After a wire or string has been threaded through a row of insert blocks, it is secured at its two extremities by any appropriate means. If the member 19 is a wire of sufficient stiffness, it may simply be bent at a right angle as shown at 19*a* in FIG. 1. Alternatively, a knot may be formed.

It should be understood that the insert members may be of any suitable material, such as wood or plastic. They may be of plastic in a variety of different colors, and may be arranged in desired patterns in the fence to form attractive designs. The plastic blocks also provide weatherability.

The above described preferred embodiment illustrates the principles of the invention but is not intended to limit its scope. Various other embodiments will be apparent to those skilled in the art and may be made without departing from the scope of the invention as defined in the claims.

I claim:

1. A chain link fence insert device for partially closing the diamond-shaped openings formed among adjacent obliquely angled wires of the fence, comprising:

a series of generally rectangular fence insert members, each having a front generally planar surface, four sides and a back surface, the back surface alone including a linear slot position generally centrally across the back surface, sized to receive a single wire of the chain link fence therein, a portion of the insert member on either side of the slot being positioned to cover and close a portion of a diamond-shaped opening on each respective side of the wire on which the slot is to be placed, a single flexible line member of sufficient length to connect a series of insert members arranged generally linearly in a row of diamond-shaped openings in the chain link fence, with one such flexible line member for each row, there being a plurality of such rows arranged generally side by side sufficient to cover the desired section of fence, and means for connecting the flexible member to each of the insert members in the row of openings so as to secure them in position on the fence.

2. A chain link fence device for partially closing the diamond-shaped openings formed among adjacent obliquely angled wires of the fence, comprising:

a series of generally rectangular fence insert members, each having a back surface including a linear slot positioned generally centrally across the back surface, sized to receive one of the wires of the chain link fence therein, a portion of the insert member on either side of the slot being positioned to cover and close a portion of a diamond-shaped opening on each respective side of the wire on which the slot is to be placed, and a plurality of flexible line members of sufficient length to connect a series of insert members arranged generally linearly in a row of diamond-shaped openings in the chain link fence, and means for connecting each flexible member to each of the insert members in the row of openings, comprising a bore through each insert member sized to receive a flexible member therethrough so as to secure the insert members in position on the fence.

3. The chain link fence insert device of claim 2, wherein the bore through the insert member has conical ends to facilitate threading of the flexible member through the bore.

4. The chain link fence insert device of claim 2, wherein the bore is transverse to the slot and crosses the slot at a location close to a bottom of the slot and spaced from the bottom of the slot just sufficiently to engage and lock the fence wire between the flexible member and the bottom of the slot.

5. The chain link fence insert device of claim 2, wherein the flexible members are metal wires and are bent at their extremities to retain the wires to a row of insert members.

6. The chain link fence insert device of claim 1, wherein the insert members are of wood.

7. The chain link fence insert device of claim 1 , wherein the insert members are of plastic in a pluralty of different colors for different insert members.

8. The chain link fence insert device of claim 7, wherein the different-colored insert members are arranged in a design pattern in the fence.

9. The chain link fence insert device of claim 1, wherein the insert members are substantially square, so that when a plurality of insert members are installed in the fence, a diamond-shaped opening is partially covered on one side by one-half of one insert member, and on the other side by one half of an adjacent insert member.

10. A method for creating privacy and wind protection in a chain link fence while enhancing the appearance of the fence, comprising:

installing decorative insert members onto the oblique wires of the chain link fence in order to partially cover the diamond-shaped openings formed among the wires, each insert member being generally rectangular and including a linear slot extending across a back surface of the member, each slot being placed over a protruding wire of the fence such that a portion of the insert member extends over one diamond-shaped opening and the opposite portion of the same insert member extends partially over an adjacent diamond-shaped opening on the other side of the wire on which the insert member is attached; and interconnecting series of the insert members by attaching flexible line members to them in a generally linear pattern, so that the flexible line members are positioned behind the fence wires on which the insert members are installed, thereby retaining the position and orientation of the insert members.

11. The method of claim 10, wherein each insert member is substantially square and the slot extends generally centrally across the back of the insert member, so that half of the insert member covers a portion of one diamond-shaped opening while the other half of the insert member covers a portion of an immediately adjacent diamond-shaped opening.

12. The method of claim 10, wherein the insert members are of wood.

13. The method of claim 10, wherein the insert member are of plastic, in various colors.

14. The method of claim 11, wherein the flexible line members are attached to the insert members via bores passing through the insert members, transverse to the slots, just behind the position of the wire in each slot.

15. The method of claim 14, wherein the flexible line members are metal wires and are bent over at their extreme ends, outside the end insert member in each row, to secure the wires in place.

* * * * *